US007945442B2

(12) United States Patent
Zhang et al.

(10) Patent No.: US 7,945,442 B2
(45) Date of Patent: May 17, 2011

(54) INTERNET COMMUNICATION DEVICE AND METHOD FOR CONTROLLING NOISE THEREOF

(75) Inventors: Ming Zhang, Cupertino, CA (US); Xiaoyan Lu, Nanjing (CN)

(73) Assignee: Fortemedia, Inc., Cupertino, CA (US)

( * ) Notice: Subject to any disclaimer, the term of this patent is extended or adjusted under 35 U.S.C. 154(b) by 1113 days.

(21) Appl. No.: 11/611,185

(22) Filed: Dec. 15, 2006

(65) Prior Publication Data

US 2008/0147393 A1 Jun. 19, 2008

(51) Int. Cl.
*G10L 21/00* (2006.01)

(52) U.S. Cl. ..... 704/226; 704/233; 381/94.2; 381/94

(58) Field of Classification Search ..... 704/226, 704/233; 381/94.2, 94
See application file for complete search history.

(56) References Cited

U.S. PATENT DOCUMENTS 5,940,499 A * 8/1999 Fujii et al. ..... 379/388.05
2002/0116187 A1* 8/2002 Erten ..... 704/233
2002/0165711 A1* 11/2002 Boland ..... 704/231
2003/0002659 A1* 1/2003 Erell ..... 379/387.01
2005/0069114 A1* 3/2005 Eran ..... 379/202.01
2006/0271358 A1* 11/2006 Erell ..... 704/225
2007/0033030 A1* 2/2007 Gottesman ..... 704/233
2007/0237339 A1* 10/2007 Konchitsky ..... 381/91
2008/0118082 A1* 5/2008 Seltzer et al. ..... 381/94.1

* cited by examiner

*Primary Examiner* — Daniel D Abebe

(74) *Attorney, Agent, or Firm* — Thomas|Kayden

(57) ABSTRACT

The invention provides an Internet communication device. The Internet communication device plays a remote audio signal received via a network and transmits an audio signal back to the remote party to complete the communication. The Internet communication device comprises a line-in speech detection module and a line-in channel control module. The line-in speech detection module detects whether the remote audio signal is speech or not to generate a remote speech detection result. The line-in channel control module then attenuates the remote audio signal if the remote speech detection result indicates that the remote audio signal is not speech, thus, all noise including non-stationary noise is removed from the remote audio signal.

22 Claims, 5 Drawing Sheets

INTERNET COMMUNICATION DEVICE AND METHOD FOR CONTROLLING NOISE THEREOF

BACKGROUND OF THE INVENTION

1. Field of the Invention

The invention relates to noise cancellation, and more particularly to noise cancellation in Internet communication devices.

2. Description of the Related Art

Because the cost of traditional circuit-switched telephony is great, Internet phones are frequently used to make domestic long distance and international calls. Consequently, Internet communication devices, such as VoIP devices and Instant Messengers, have become popular. For Instant Messengers such as Skype, MSN Messenger, Yahoo Messenger, Google Talker, and AOL Messenger are examples of software applications for Internet communication. Increased use of Internet communication devices demands increased audio quality of Internet communication devices. One of the greatest obstacles to audio quality of Internet communication devices is noise.

Noise from computer fans, typing, and mouse movement is often received by the microphone of an Internet communication device connected to the computer. Internet communication devices comprising noise suppression modules are typically capable of canceling a majority of the stationary noise with certain level in order not to affect too much on voice quality. In such case, quite some residual noise will be remained, even after noise suppression. In addition, normal noise suppression modules, however, cannot eliminate non-stationary noise.

Because the noise of each party is independent, when multiple parties are VoIP conferencing, the total level of noise is the sum of the noise of each party. Automatic gain control modules connected to Internet communication devices may further amplify and increase noise. Thus, a method for handling noise, particularly on non-stationary noise of Internet communication devices to improve audio quality Internet communication devices is desirable.

BRIEF SUMMARY OF THE INVENTION

The invention provides an Internet communication devices. An exemplary embodiment of the Internet communication device plays a remote audio signal received through a network and transmits an audio signal to a remote user to complete the communication. The Internet communication device comprises a line-in speech detection module and a line-in channel control module. The line-in speech detection module detects whether or not the remote audio signal is speech to generate a remote speech detection result. The line-in channel control module then attenuates the remote audio signal if the remote speech detection result indicates that the remote audio signal is not speech, thus, noise is removed from the remote audio signal.

A method for controlling noise of an Internet communication device is also provided. The Internet communication device outputs a remote audio signal received from a network and transmits an audio signal to a remote user through the network to complete a conversation. Whether the remote audio signal is speech or not is first detected to generate a remote speech detection result. The remote audio signal is then attenuated if the remote speech detection result indicates that the remote audio signal is not speech, thus, noise is removed from the remote audio signal.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
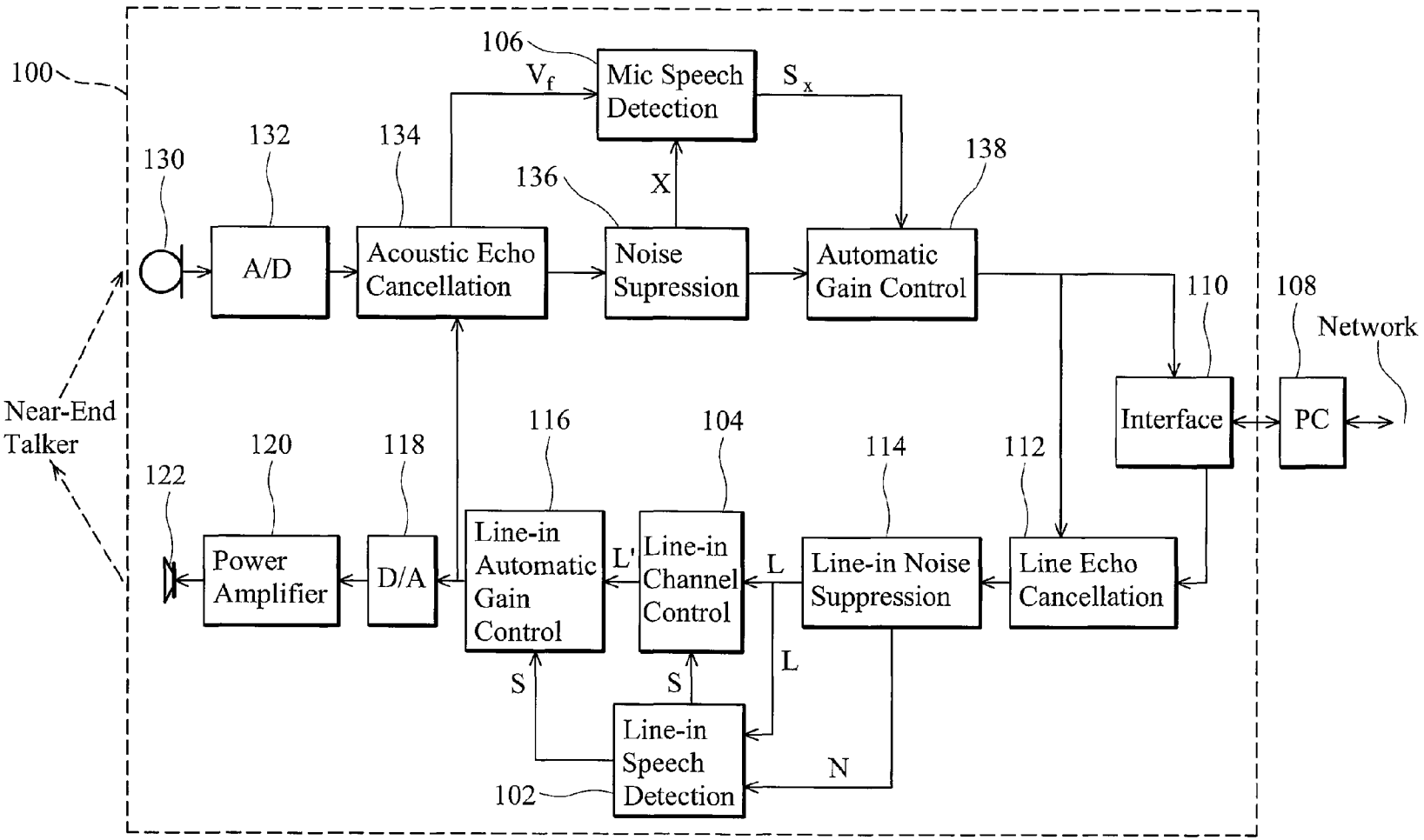
FIG. 1 is a block diagram of an Internet communication device with noise control according to the invention.

FIG. 1 is a block diagram of an Internet communication device 100 with noise control according to the invention. The Internet communication device 100 is connected to a personal computer 108, which is further connected to a network. The Internet communication device 100 may be a physical IP phone or a software speakerphone module in personal computer 108. The Internet communication device 100 receives an audio signal from a near-end user and transmits the audio signal to a remote Internet communication device via the network. The Internet communication device 100 also receives a remote audio signal from the remote Internet communication device through the network and then plays the remote audio signal. Thus, communication is conducted between two Internet communication devices. There can be more than one remote Internet communication device communicating with Internet communication device 100, such as in a multi-party VoIP conference.

The Internet communication device 100 is connected to the personal computer 108 via an interface 110, such as a USB interface, an analog audio interface, or a software API interface if the Internet communication device 100 is a software speakerphone module. Subsequent to the Internet communication device 100 receiving the remote audio signal through the Interface 110, the remote audio signal is processed by line-in signal path modules of the Internet communication device 100 before being output by a loudspeaker 122. The line-in signal path is shown in the lower half of FIG. 1 and includes a line echo cancellation module 112, a line-in noise suppression module 114, a line-in speech detection module 102, a line-in channel control module 104, a line-in automatic gain control module 116, a digital to analog converter 118, and a power amplifier 120.

The line echo cancellation module 112 removes the echo caused by the network or line from the remote audio signal. The line-in noise suppression module 114 then removes some stationary noise from the remote audio signal. Only part of the stationary noise, however, can be eliminated because the remote audio is attenuated in conjunction with the elimination of the stationary noise. In addition, non-stationary noise cannot be removed by the line-in noise suppression module 114. Thus, two modules, the line-in speech detection module 102 and the line-in channel control module 104, are added to the Internet communication device 100 to cancel the residual noise and non-stationary noise carried by the remote audio signal.

The line-in speech detection module 102 first detects whether or not the remote audio signal is real speech. If the remote audio signal is real speech, a remote speech detection result with a value of 1 is generated. Otherwise, a remote speech detection result with a value of 0 is generated. The remote speech detection result is delivered to the line-in channel control module 104. If the remote speech detection result indicates that the remote audio signal is not speech, the line-in channel control module 104 attenuates the remote audio signal. For example, the line-in channel control module 104 mutes a non-speech remote audio signal. Thus, all noise including non-stationary noise is removed from the remote audio signal. The line-in automatic gain control module 116 then adjusts the signal level of the remote audio signal to an appropriate level. After being further converted to an analog signal and amplified by power amplifier 120, the remote audio signal is output by loudspeaker 122, allowing the user to hear the remote audio signal with no noise.

The microphone 130 receives an audio signal from a user. The audio signal is then processed by line-out signal path modules of Internet communication device 100 before transmission via interface 110 to a network. The line-out signal path is shown in the upper half of FIG. 1 and includes an analog to digital converter 132, an acoustic echo cancellation module 134, a noise suppression module 136, a microphone speech detection module 106, and an automatic gain control module 138. The microphone speech detection module 106 is added to the Internet communication device 100 to cancel all noise including non-stationary noise carried by the audio signal. Similar to the line-in speech detection module 102, the microphone speech detection module 106 detects whether or not the audio signal is speech to generate a speech detection result. If the speech detection result indicates that the audio signal is not speech, the automatic gain control module 138 does not amplify the audio signal. Thus, the residual noise and non-stationary noise carried by the audio signal are prevented from being amplified before transmission.

Figure 2:
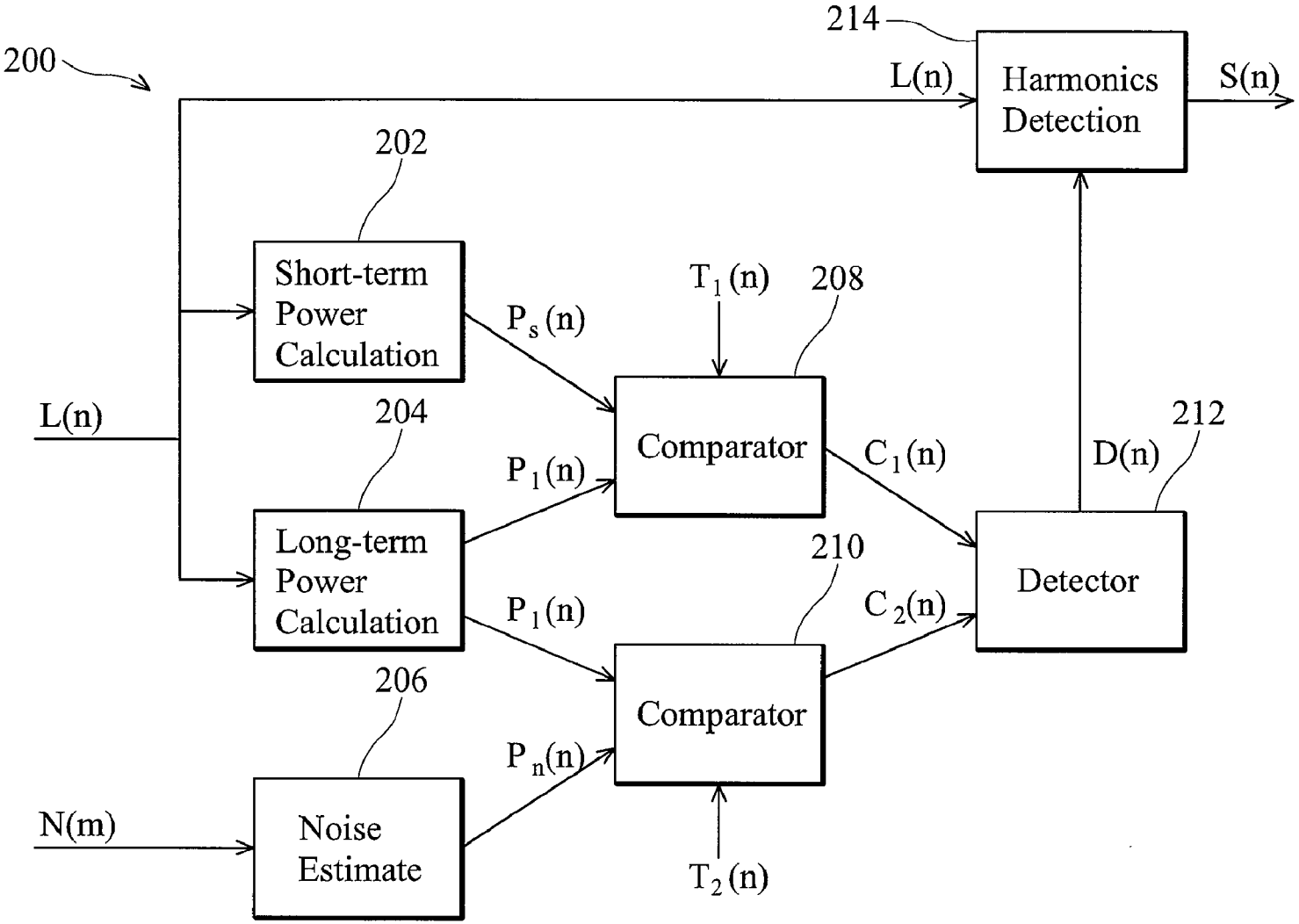
FIG. 2 is a block diagram of a line-in speech detection module according to the invention.

FIG. 2 is a block diagram of a line-in speech detection module 200 according to the invention. The line-in speech detection module 200 includes a short-term power calculation module 202, a long-term power calculation module 204, a noise estimation module 206, two comparators 208 and 210, a detector module 212, and a harmonic detection module 214. The short-term power calculation module 202 measures a short-term power Ps(n) of the remote audio signal L(n) with a faster update speed. The long-term power calculation module 204 measures a long-term power $P_l(n)$ of the remote audio signal L(n) with a slower update speed. The short-term power Ps(n) and the long-term power $P_l(n)$ are determined according to the following algorithm:

$$P_s(n)=\alpha_s \cdot P_s(n-1)+(1-\alpha_s)\cdot L(n)\cdot L(n); \text{ and} \tag{1}$$

$$P_l(n)=\alpha_l \cdot P_l(n-1)+(1-\alpha_l)\cdot L(n)\cdot L(n); \tag{2}$$

wherein the L(n) is the remote audio signal, the $\alpha_s$ is a predetermined short-term smoothing parameter, the $\alpha_l$ is a predetermined long-term smoothing parameter and the n is a sample index. The short-term smoothing parameter $\alpha_s$ and the long-term smoothing parameter $\alpha_l$ are chosen that $(1-\alpha_l)$ is at least one order less than $(1-\alpha_s)$, such that the short-term power Ps(n) is updated faster than the long-term power $P_l(n)$.

The noise estimation module 206 derives a noise power estimate $P_n(n)$ from a noise estimate N(m) of the remote audio signal. The frequency domain noise estimate N(m) is obtained from the line-in noise suppression module 114 of FIG. 1. The time domain noise power estimate $P_n(n)$ is determined according to the following algorithms:

$$Q(k)=\frac{1}{M}\sum_{m=1}^{M} N(m)\cdot N(m); \text{ and} \tag{3}$$

$$P_n(n)=Q([2n/M]); \tag{4}$$

wherein the k is a frame index, M is a frame size for frequency domain processing, and the function [x] denotes an integer closest to x.

After the short-term power Ps(n), the long-term power $P_l(n)$, and the noise power estimate $P_n(n)$ are obtained, they are delivered to the comparators 208 and 210. The comparator 208 compares the difference between the short-term and the long-term powers Ps(n) and $P_l(n)$ with a first threshold $T_1(n)$ to generate a first comparison result $C_1(n)$. The comparator 210 compares the difference between the long-term power $P_l(n)$ and the noise power estimate $P_n(n)$ with a second threshold $T_2(n)$ to generate a second comparison result $C_2(n)$. The first comparison result $C_1(n)$ and the second comparison result $C_2(n)$ are determined according to the following algorithms:

$$C_1(n)=\begin{cases} 0, & |\log P_s(n)-\log P_l(n)| \le T_1(n) \\ 1, & |\log P_s(n)-\log P_l(n)| > T_1(n) \end{cases}; \text{ and} \tag{5}$$

$$C_2(n)=\begin{cases} 0, & |\log P_l(n)-\log P_n(n)| \le T_2(n) \\ 1, & |\log P_l(n)-\log P_n(n)| > T_2(n) \end{cases}; \tag{6}$$

wherein the function |x| denotes the absolute value of x, and log(x) denotes basis-10 logarithm of x.

If the first comparison result $C_1(n)$ indicates that the short-term power Ps(n) is much greater than the long-term power $P_l(n)$, and the second comparison result $C_2(n)$ indicates that the long-term power $P_l(n)$ is much greater than the long-term power $P_n(n)$, both the first comparison result $C_1(n)$ and the second comparison result $C_2(n)$ are true, and the detector module 212 enables a detector output D(n) to trigger the harmonic detection module 214. Thus, the detector output D(n) is determined according to the following algorithm:

$$D(n)=\begin{cases} 1, & C_1(n)=1 \text{ and } C_2(n)=1 \\ 0, & C_1(n)=0 \text{ or } C_2(n)=0 \end{cases}. \tag{7}$$

When triggered by the detector output D(n), the harmonic detection module 214 perform harmonic analysis on the remote audio signal L(n) to detect whether the remote audio signal L(n) consists of real speech or not. If the remote audio signal L(n) comprises speech, the harmonic detection module 214 generates a remote speech detection result S(n) with the value "1", indicating the existence of speech. Thus, the line-in channel control module 104 of FIG. 1 can mutes the remote audio signal L(n) according to the remote speech detection result S(n). In one embodiment, the harmonic detection module 214 may perform harmonic analysis based on the method provided by E. Fisher, etc. in the "Generalized likelihood ratio test for voiced-unvoiced decision in noisy speech using the harmonic model", IEEE Trans. On Audio, Speech and Language Processing, Vol. 14, No. 2, March 2006, or the method provided by J. Tabrikian, etc. in the "Tracking speech in a noisy environment using the harmonic model", IEEE Trans. Speech and Audio Processing, Vol. 12, No. 1, January 2004.

Figure 3:
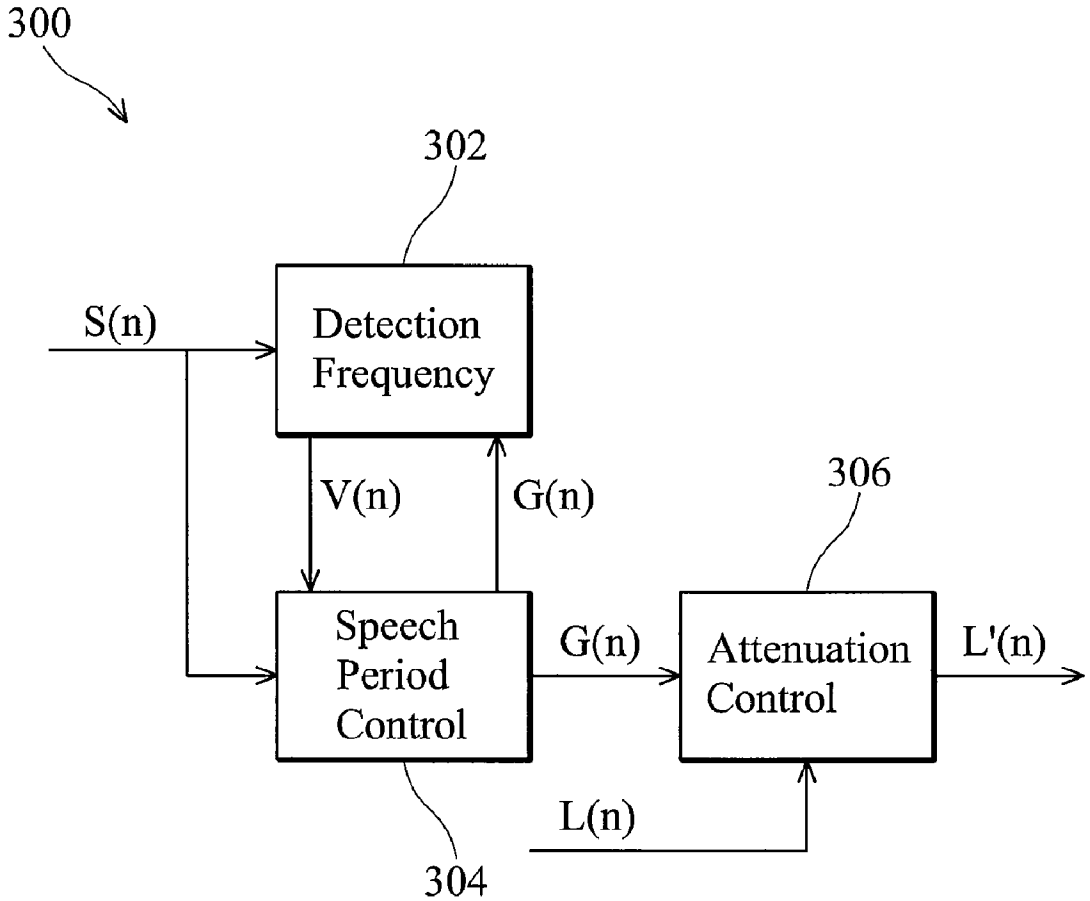
FIG. 3 is a block diagram of a line-in channel control module according to the invention.

FIG. 3 is a block diagram of a line-in channel control module 300 according to the invention. The line-in channel control module 300 includes a detection frequency module 302, a speech period control module 304, and an attenuation control module 306. The detection frequency module 302 counts a frequency that the remote speech detection result S(n) is true during a speech period of a speech period signal G(n) to determine a detection frequency V(n), wherein the speech period is a period during which the speech period signal G(n) is true. The detection frequency V(n) is determined according to the following algorithm:

$$V(n) = \begin{cases} 1, & S(n) = 1, \text{ or } [G(n) = 1 \text{ and } V(n-i) = 0, \text{ any } i \in 1, \ldots, B] \\ 2, & S(n) = 1, \text{ or } [G(n) = 1 \text{ and } V(n-i) = 1, i = 1, \ldots, B] \\ 0, & \text{Others} \end{cases}. \quad (8)$$

The speech period control module 304 then generates the speech period signal G(n) to control the attenuation of the remote audio signal L(n) according to the detection frequency V(n) and the remote speech detection result S(n). If the detection frequency V(n) is greater than a frequency threshold B, the speech period is extended by the speech period control module 304. Otherwise, the speech period is shortened if the detection frequency is less than the frequency threshold B. Thus, during a conversation between two Internet communication devices, the remote audio signal L(n) is not repeatedly muted for short periods with high frequency, thus eliminating harsh, potentially ear damaging sound in remote audio signal L(n). The attenuation control module 306 then mutes the remote audio signal L(n) according to the speech period signal G(n) to obtain the remote audio signal L'(n). The speech period signal G(n) is determined according to the following algorithms:

$$H(n) = \begin{cases} K/J, & S(n) = 1, V(n-i) = 1, i < B \\ K, & S(n) = 1, V(n-i) = 1, i = 1, \ldots, B; \\ \max[H(n)-1, 0], & \text{Others} \end{cases} \quad (9)$$

$$Y(n) = \begin{cases} 1, & H(n) > 0 \\ 0, & \text{Others} \end{cases}; \text{ and} \quad (10)$$

$$G(n) = \begin{cases} 1, & Y(n) = 1 \\ 0, & \text{Others} \end{cases}. \quad (11)$$

Figure 4:
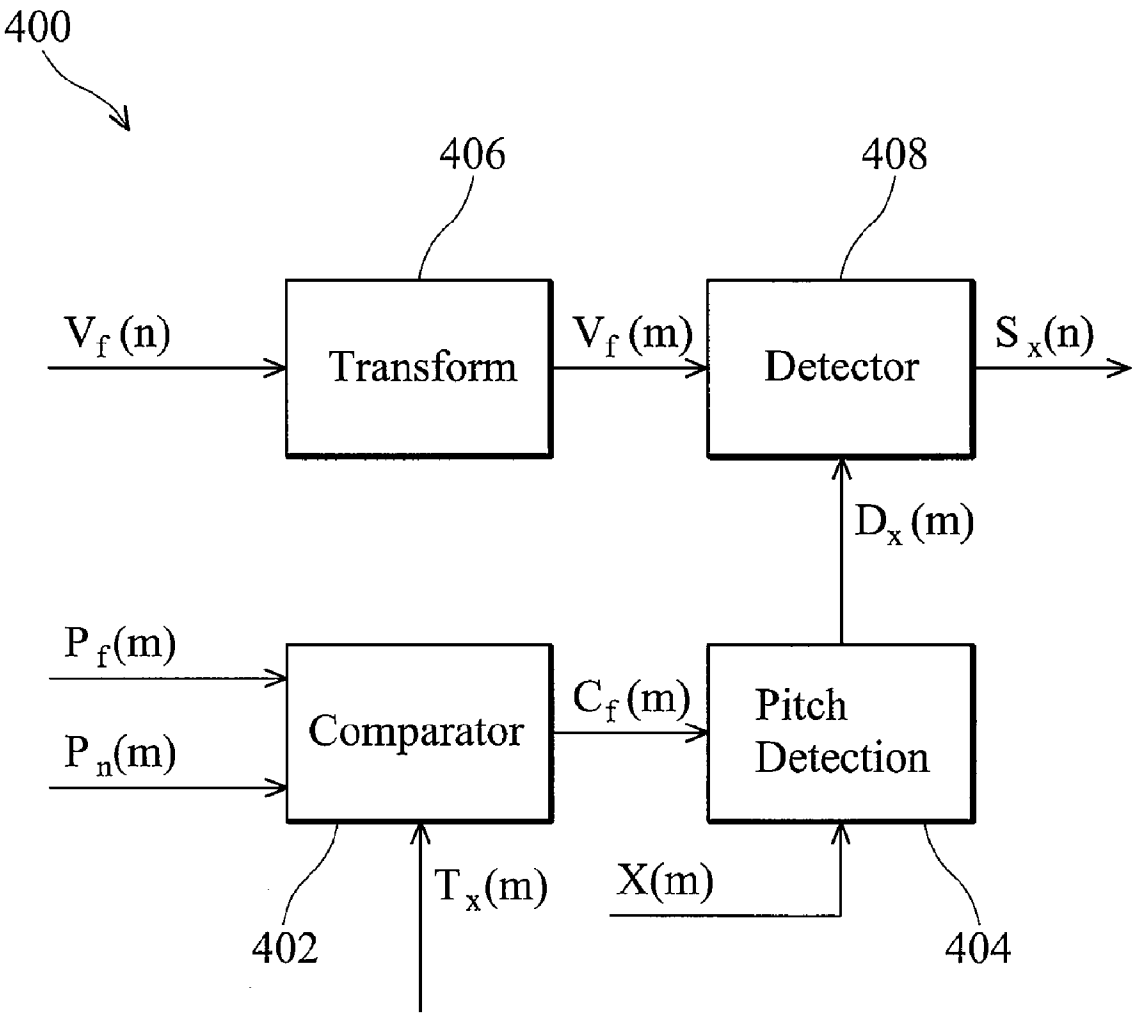
FIG. 4 is a block diagram of a microphone speech detection module according to the invention.

FIG. 4 is a block diagram of a microphone speech detection module 400 according to the invention. The microphone speech detection module 400 includes a comparator 402, a pitch detection module 404, a transformation module 406, and a detector module 408. The transformation module 406 converts a time-domain remote detection signal $V_f(n)$ indicating the existence of speech of the remote audio signal to a frequency-domain remote detection signal $V_f(m)$. Thus, if the remote detection signal $V_f(m)$ is positive, a conversation is underway and the probability that the audio signal comprises speech is greater. The frequency-domain remote detection signal $V_f(m)$ is determined according to the following algorithm:

$$V_f(m) = \begin{cases} 1, & V_f[(m-1)\cdot M] = 1 \text{ and } V_f(m\cdot M - 1) = 1 \\ 0, & \text{Others} \end{cases}; \quad (12)$$

wherein m is a frame index, and M is a frame size for frequency domain processing.

The comparator 402 determines whether a difference between a power $P_x(m)$ of the audio signal and a stationary noise estimate power $P_n(m)$ of the audio signal is greater than a third threshold $T_x(m)$ to obtain a third comparison result $C_f(m)$. If the third comparison result $C_f(m)$ is true, it means that the power $P_x(m)$ of the audio signal is much larger than the stationary noise estimate power $P_n(m)$, and the audio signal may comprise speech. Thus, the pitch detection module 404 is triggered to perform pitch detection on the audio signal X(m) to generate a pitch detection signal $D_x(m)$. If the pitch detection is positive, the audio signal is confirmed to comprise speech. In one embodiment, the pitch detection module 404 performs pitch detection based on the method provided by D. Huang, etc. in "Speech pitch detection in noisy environment using multi-rate adaptive lossless FIR filters", ISCAS'04, 22-26 May 2004, or the method provided by L. Hui, etc. in "A Pitch Detection Algorithm Based on AMDF and ACF", ICASSP'06, 14-19 May 2006.

If both the pitch detection signal $D_x(m)$ and the remote detection signal $V_f(m)$ are true, a conversation between Internet communication devices is underway, and the detector module 408 enables the speech detection result $S_x(n)$. Thus, the automatic gain control module 138 of FIG. 1 can then amplify audio signal X(m) according to speech detection result $S_x(n)$. The speech detection result $S_x(n)$ is determined according to the following algorithms:

$$S_x(m) = \begin{cases} 1, & V_f(m) = 1 \text{ and } D_x(m) = 1 \\ 0, & \text{Others} \end{cases}; \text{ and} \quad (13)$$

$$S_x(n) = S_x(m\cdot M) \text{ for } m = \lceil n/M \rceil; \quad (14)$$

wherein $S_x(m)$ is the speech detection result of frequency domain, the $S_x(n)$ is the speech detection result of time domain, and the function [x] denotes an integer closest to x.

Figure 5:
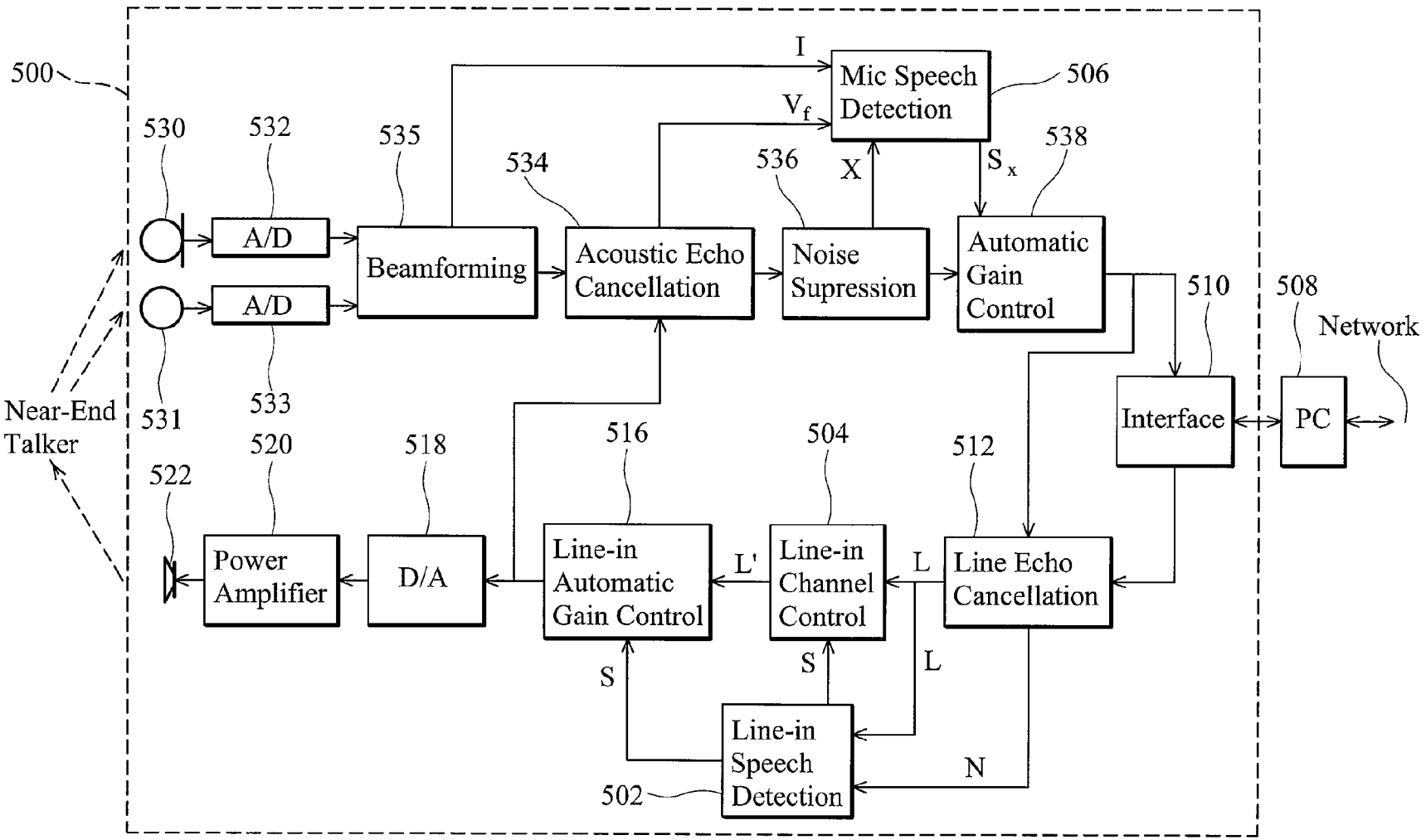
FIG. 5 is a block diagram of an Internet communication device with an array microphone according to the invention.

FIG. 5 is a block diagram of a Internet communication device 500 with an array microphone according to the invention. The Internet communication device 500 is roughly similar to the Internet communication device 100 of FIG. 1, except for an array microphone and the beam-forming module 535. The array microphone includes two microphones 530 and 531 to receive two audio signals at different locations, and the beam-forming module 535 can suppress noise from the beam. The beam-forming module 535 can also provide in-beam and out-of-beam information I for the microphone speech detection module 506. Thus, the microphone speech detection module 506 generates the speech detection result with better precision.

The invention provides a method for controlling noise of an Internet communication device. A line-in speech detection module is added to detect the speech of a remote audio signal sent by a far-end talker, and the remote audio signal is muted by a line-in channel control module if the remote audio signal is not speech. A microphone speech detection module is added to detect the speech of an audio signal received from a near-end talker, and the audio signal is not amplified if the audio signal is not speech. Thus, the noise including non-stationary noise is eliminated from the remote audio signal and the audio signal, and the audio quality of the Internet communication device is improved.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An Internet communication device, playing a remote audio signal received through a network and transmitting an audio signal to a remote user through the network to complete a conversation, comprising:

a line-in speech detection module, detecting whether the remote audio signal is speech or not to generate a remote speech detection result; and a line-in channel control module, coupled to the line-in speech detection module, muting the remote audio signal when the remote speech detection result indicates that the remote audio signal is not speech, thus, noise is removed from the remote audio signal;

wherein the line-in channel control module comprises:

a detection frequency module, counting the frequency that the remote speech detection result is true during a speech period of a speech period signal to determine a detection frequency, wherein the speech period is a period during which the speech period signal is true;

the speech period control module, coupled to the detection frequency module, generating the speech period signal to control muting of the remote audio signal, extending the speech period if the detection frequency is greater than a frequency threshold, and shortening the speech period if the detection frequency is less than a frequency threshold; and an attenuation control module, coupled to the detection frequency module and the speech period control module, muting the remote audio signal according to the speech period signal.

2. The Internet communication device as claimed in claim 1, wherein the Internet communication device further comprises:

a microphone speech detection module, detecting whether the an audio signal is speech or not to generate a speech detection result; and an automatic gain control module, coupled to the microphone speech detection module, amplifying the audio signal if the speech detection result indicates that the audio signal is speech, thus preventing noise from being amplified.

3. The Internet communication device as claimed in claim 2, wherein the microphone speech detection module comprises:

a third comparator, determining whether a difference between a power of the audio signal and a stationary noise estimate power of the audio signal is greater than a third threshold to obtain a third comparison result;

a pitch detection module, coupled to the third comparator, performing pitch detection on the audio signal to generate a pitch detection signal when triggered by the third comparison result;

a transformation module, converting a remote detection signal indicating the existence of speech of the remote audio signal from a time domain to a frequency domain; and a detector module, coupled to the pitch detection module and the transformation module, enabling the speech detection result if both the pitch detection signal and the remote detection signal are true.

4. The Internet communication device as claimed in claim 3, wherein the transformation module converts the remote detection signal from the time domain to the frequency domain according to the following algorithm:

$$V_f(m) = \begin{cases} 1, & V_f[(m-1)\cdot M] = 1 \text{ and } V_f(m\cdot M - 1) = 1 \\ 0, & \text{Others} \end{cases};$$

wherein $V_f(m)$ is the remote detection signal of frequency domain, m is a frame index, and M is a frame size for frequency domain processing.

5. The Internet communication device as claimed in claim 3, wherein the detector module generates the speech detection result according to the following algorithms:

$$S_x(m) = \begin{cases} 1, & V_f(m) = 1 \text{ and } D_x(m) = 1 \\ 0, & \text{Others} \end{cases}; \text{ and}$$

$$S_x(n) = S_x(m\cdot M) \text{ for } m = \lceil n/M \rceil;$$

wherein the $S_x(m)$ is the speech detection result of frequency domain, the $S_x(n)$ is the speech detection result of time domain, the $V_f(m)$ is the remote detection signal, the $D_x(m)$ is the pitch detection signal, the function [x] denotes an integer closest to x, m is a frame index, n is a sample index, and M is a frame size for frequency domain processing.

6. The Internet communication device as claimed in claim 2, wherein the Internet communication device includes an array microphone and a beam-forming module for generating the audio signal, and the beam-forming module provides in-beam and out-of-beam information for the microphone speech detection module to generate the speech detection result with more precision.

7. The Internet communication device as claimed in claim 1, wherein the line-in speech detection module comprises:

a short-term power calculation module, measuring a short-term power of the remote audio signal with a faster update speed;

a long-term power calculation module, measuring a long-term power of the remote audio signal with a slower update speed;

a noise estimation module, obtaining a noise power estimate of the remote audio signal;

a first comparator, coupled to the short-term and the long-term power calculation modules, generating a first comparison result indicating whether a difference between the short-term power and the long-term power is greater than a first threshold;

a second comparator, coupled to the long-term power calculation module and the noise estimation module, generating a second comparison result indicating whether a difference between the long-term power and the noise power estimate is greater than a second threshold;

a detector module, coupled to the first and the second comparators, generating a detector output indicating whether both the first and second comparison results are true; and a harmonics detection module, coupled to the detector module, performing harmonic analysis on the remote audio signal to generate the remote speech detection result indicating whether the remote audio signal comprises speech when triggered by the detector output.

8. The Internet communication device as claimed in claim 7, wherein the short-term power calculation module measures the short-term power according to the following algorithm:

$$P_s(n)=\alpha_s \cdot P_s(n-1)+(1-\alpha_s)\cdot L(n)\cdot L(n);$$

wherein the L(n) is the remote audio signal, the Ps(n) is the short-term power, the $\alpha_s$ is a predetermined short-term smoothing parameter, and the n is a sample index of the remote audio signal;

and the long-term power calculation module measures the long-term power according to the following algorithm:

$$P_l(n)=\alpha_l \cdot P_l(n-1)+(1-\alpha_l)\cdot L(n)\cdot L(n);$$

wherein the L(n) is the remote audio signal, the $P_l(n)$ is the long-term power, the $\alpha_l$ is a predetermined long-term smoothing parameter wherein $(1-\alpha_l)$ is at least one order less than $(1-\alpha_s)$, and the n is a sample index of the remote audio signal.

9. The Internet communication device as claimed in claim 7, wherein the noise power estimate is obtained according to the following algorithms:

$$Q(k)=\frac{1}{M}\sum_{m=1}^{M} N(m)\cdot N(m);\ \text{and}\ P_n(n)=Q([2n/M]);$$

wherein the $P_n(n)$ is the noise power estimate, the N(m) is a frequency domain noise estimate, the function [x] denotes an integer closest to x, the k is a frame index, and M is a frame size for frequency domain processing.

10. The Internet communication device as claimed in claim 7, wherein the first comparator generates the first comparison result according to the following algorithm:

$$C_1(n)=\begin{cases} 0, & |\log P_s(n)-\log P_l(n)| \le T_1(n) \\ 1, & |\log P_s(n)-\log P_l(n)| > T_1(n) \end{cases};$$

wherein $C_1(n)$ is the first comparison result, Ps(n) is the short-term power, $P_l(n)$ is the long-term power, and $T_1(n)$ is the first threshold;

and the second comparator generates the second comparison result according to the following algorithm:

$$C_2(n)=\begin{cases} 0, & |\log P_l(n)-\log P_n(n)| \le T_2(n) \\ 1, & |\log P_l(n)-\log P_n(n)| > T_2(n) \end{cases};$$

wherein $C_2(n)$ is the second comparison result, $P_l(n)$ is the long-term power, $P_n(n)$ is the noise power estimate, and $T_2(n)$ is the second threshold;

and the detector module generates the detector output according to the following algorithm:

$$D(n)=\begin{cases} 1, & C_1(n)=1 \text{ and } C_2(n)=1 \\ 0, & C_1(n)=0 \text{ or } C_2(n)=0 \end{cases};$$

wherein D(n) is the detector output, $C_1(n)$ is the first comparison result, and $C_2(n)$ is the second comparison result.

11. The Internet communication device as claimed in claim 1, wherein the detection frequency module determines the detection frequency according to the following algorithm:

$$V(n)=\begin{cases} 1, & S(n)=1, \text{ or } [G(n)=1 \text{ and } V(n-i)=0, \text{ any } i \in 1, \ldots, B] \\ 2, & S(n)=1, \text{ or } [G(n)=1 \text{ and } V(n-i)=1, i=1, \ldots, B] \\ 0, & \text{Others} \end{cases};$$

wherein V(n) is the detection frequency, n is a sample index, S(n) is the remote speech detection result, and G(n) is the speech period signal;

and the speech period control module generates the speech period signal according to the following algorithms:

$$H(n)=\begin{cases} K/J, & S(n)=1, V(n-i)=1, i<B \\ K, & S(n)=1, V(n-i)=1, i=1, \ldots, B \\ \max[H(n)-1,0], & \text{Others} \end{cases};$$

$$Y(n)=\begin{cases} 1, & H(n)>0 \\ 0, & \text{Others} \end{cases};\ \text{and}$$

$$G(n)=\begin{cases} 1, & Y(n)=1 \\ 0, & \text{Others} \end{cases};$$

wherein the G(n) is the speech period signal, n is a sample index, V(n) is the detection frequency, S(n) is the remote speech detection result, and B is the frequency threshold.

12. A method for controlling noise of an Internet communication device, wherein the Internet communication device plays a remote audio signal received via a network and transmits an audio signal to a remote user via the network to complete a conversation, the method comprising:

detecting whether the remote audio signal is speech or not to generate a remote speech detection result; and muting the remote audio signal when the remote speech detection result indicates that the remote audio signal is not speech, thus, noise is removed from the remote audio signal;

wherein the muting of the remote audio signal comprises:

counting the frequency that the remote speech detection result is true during a speech period of a speech period signal to determine a detection frequency, wherein the speech period is a period during which the speech period signal is true;

extending the speech period if the detection frequency is greater than a frequency threshold;

shortening the speech period if the detection frequency is less than a frequency threshold; and muting the remote audio signal during time other than the speech period according to the speech period signal.

13. The method as claimed in claim 12, wherein the method further comprises:

detecting whether the audio signal is speech or not to generate a speech detection result; and amplifying the audio signal if the speech detection result indicates that the audio signal is speech, thus preventing noise from being amplified.

14. The method as claimed in claim 13, wherein the generating of the speech detection result comprises:

determining whether a difference between a power of the audio signal and a stationary noise estimate power of the audio signal is greater than a third threshold to obtain a third comparison result;

performing pitch detection on the audio signal to generate a pitch detection signal when triggered by the third comparison result;

converting a remote detection signal indicating the existence of speech of the remote audio signal from time to frequency domains; and enabling the speech detection result if both the pitch detection signal and the remote detection signal are true.

15. The method as claimed in claim 14, wherein the remote detection signal is converted from the time to the frequency domain according to the following algorithm:

$$V_f(m) = \begin{cases} 1, & V_f[(m-1)\cdot M] = 1 \text{ and } V_f(m\cdot M - 1) = 1 \\ 0, & \text{Others} \end{cases};$$

wherein $V_f(m)$ is the remote detection signal of frequency domain, m is a frame index, and M is a frame size for frequency domain processing.

16. The method as claimed in claim 14, wherein the speech detection result is generated according to the following algorithms:

$$S_x(m) = \begin{cases} 1, & V_f(m) = 1 \text{ and } D_x(m) = 1 \\ 0, & \text{Others} \end{cases}; \text{ and}$$

$$S_x(n) = S_x(m\cdot M) \text{ for } m = \lceil n/M \rceil;$$

wherein the $S_x(m)$ is the speech detection result of frequency domain, the $S_x(n)$ is the speech detection result of time domain, the $V_f(m)$ is the remote detection signal, the $D_x(m)$ is the pitch detection signal, the function [x] denotes an integer closest to x, m is a frame index, the n is a sample index, and M is a frame size for frequency domain processing.

17. The method as claimed in claim 13, wherein the Internet communication device includes an array microphone and a beam-forming module for generating the audio signal, and the speech detection result is further precisely generated according to in-beam and out-of-beam information provided by the beam-forming module.

18. The method as claimed in claim 12, wherein the generating of the remote speech detection result comprises:

measuring a short-term power of the remote audio signal with faster update speed;

measuring a long-term power of the remote audio signal with slower update speed;

obtaining a noise power estimate of the remote audio signal;

determining whether a difference between the short-term and the long-term powers is greater than a first threshold to generate a first comparison result;

determining whether a difference between the long-term power and the noise power estimate is greater than a second threshold to generate a second comparison result;

generating a detector output indicating whether both the first and second comparison results are true; and performing harmonic analysis on the remote audio signal to generate the remote speech detection result when triggered by the detector output.

19. The method as claimed in claim 18, wherein the short-term power is measured according to the following algorithm:

$$P_s(n)=\alpha_s\cdot P_s(n-1)+(1-\alpha_s)\cdot L(n)\cdot L(n);$$

wherein the L(n) is the remote audio signal, the Ps(n) is the short-term power, the $\alpha_s$ is a predetermined short-term smoothing parameter, and the n is a sample index of the remote audio signal;

and the long-term power is measured according to the following algorithm:

$$P_l(n)=\alpha_l\cdot P_l(n-1)+(1-\alpha_l)\cdot L(n)\cdot L(n);$$

wherein the L(n) is the remote audio signal, the $P_l(n)$ is the long-term power, the $\alpha_l$ is a predetermined long-term smoothing parameter wherein $(1-\alpha_l)$ is at least one order less than $(1-\alpha_s)$, and the n is a sample index of the remote audio signal.

20. The method as claimed in claim 18, wherein the noise power estimate is obtained according to the following algorithms:

$$Q(k) = \frac{1}{M}\sum_{m=1}^{M} N(m)\cdot N(m); \text{ and}$$

$$P_n(n) = Q([2n/M]);$$

wherein the $P_n(n)$ is the noise power estimate, the function [x] denotes an integer closest to x, the k is a frame index, and M is a frame size for frequency domain processing.

21. The method as claimed in claim 18, wherein the first comparison result is generated according to the following algorithm:

$$C_1(n) = \begin{cases} 0, & |\log P_s(n) - \log P_l(n)| \le T_1(n) \\ 1, & |\log P_s(n) - \log P_l(n)| > T_1(n) \end{cases};$$

wherein $C_1(n)$ is the first comparison result, Ps(n) is the short-term power, $P_l(n)$ is the long-term power, and $T_1(n)$ is the first threshold;

and the second comparison result is generated according to the following algorithm:

$$C_2(n) = \begin{cases} 0, & |\log P_l(n) - \log P_n(n)| \le T_2(n) \\ 1, & |\log P_l(n) - \log P_n(n)| > T_2(n) \end{cases};$$

wherein $C_2(n)$ is the second comparison result, $P_l(n)$ is the long-term power, $P_n(n)$ is the noise power estimate, and $T_2(n)$ is the second threshold;

and the detector output is generated according to the following algorithm:

$$D(n) = \begin{cases} 1, & C_1(n) = 1 \text{ and } C_2(n) = 1 \\ 0, & C_1(n) = 0 \text{ or } C_2(n) = 0 \end{cases};$$

wherein D(n) is the detector output, $C_1(n)$ is the first comparison result, and $C_2(n)$ is the second comparison result.

22. The method as claimed in claim 12, wherein the detection frequency is determined according to the following algorithm:

$$V(n)=\begin{cases}1, & S(n)=1,\text{ or }[G(n)=1\text{ and }V(n-i)=0,\text{ any }i\in 1,\ldots,B]\\ 2, & S(n)=1,\text{ or }[G(n)=1\text{ and }V(n-i)=1,\ i=1,\ldots,B]\\ 0, & \text{Others}\end{cases};$$

wherein V(n) is the detection frequency, n is a sample index, S(n) is the remote speech detection result, and G(n) is the speech period signal;

and the speech period signal is generated according to the following algorithms:

$$H(n)=\begin{cases}K/J, & S(n)=1,\ V(n-i)=1,\ i<B\\ K, & S(n)=1,\ V(n-i)=1,\ i=1,\ldots,B\\ \max[H(n)-1,0], & \text{Others}\end{cases};$$

-continued $$Y(n)=\begin{cases}1, & H(n)>0\\ 0, & \text{Others}\end{cases};\text{ and}$$

$$G(n)=\begin{cases}1, & Y(n)=1\\ 0, & \text{Others}\end{cases};$$

wherein the G(n) is the speech period signal, n is a sample index, V(n) is the detection frequency, S(n) is the remote speech detection result, and B is the frequency threshold.

* * * * *